US006443083B2

(12) United States Patent
Müller

(10) Patent No.: US 6,443,083 B2
(45) Date of Patent: Sep. 3, 2002

(54) HAND-LEVER CONTROL FOR MOTOR AND SPORT BOATS

(75) Inventor: Peter Müller, Adliswill (CH)

(73) Assignee: NASYC Holding S. A., Luxembourg (LU)

( * ) Notice: Subject to any disclaimer, the term of this patent is extended or adjusted under 35 U.S.C. 154(b) by 31 days.

(21) Appl. No.: 09/751,364

(22) Filed: Dec. 28, 2000

(30) Foreign Application Priority Data

Dec. 28, 1999 (DE) ..... 199 63 476

(51) Int. Cl.[7] ..... B63H 25/00
(52) U.S. Cl. ..... 114/144 RE; 440/84; 440/87
(58) Field of Search ..... 440/84, 86, 87; 114/144 RE

(56) References Cited

U.S. PATENT DOCUMENTS 3,135,234 A * 6/1964 Turnidge ..... 440/61
3,709,187 A * 1/1973 Marco et al. ..... 416/130
3,724,970 A * 4/1973 Kobelt ..... 416/27
3,826,590 A * 7/1974 Kobelt ..... 416/27

FOREIGN PATENT DOCUMENTS

DE 1 085 712 7/1954
EP 0 778 196 6/1997

OTHER PUBLICATIONS

"Kupplingssteuerung by Schiffs–Wende–Untersetzungegetrieben", Andreas Steinbach, Schiffbau—133.Jahrga_ ng–1996, Nr.7, 4 pages.

* cited by examiner

*Primary Examiner*—Jesus D. Sotelo
(74) *Attorney, Agent, or Firm*—Herbert Dubno; Andrew Wilford

(57) ABSTRACT

The invention relates to a hand-lever control for motor and sport boats with a hand lever having a handle and guided in at least one function plane for controlling the engine. In order to facilitate maneuvering for the pilot, the hand lever or its handle is pivotal about the axis of the hand lever in two directions against a spring force and at least one sensor detecting this rotation is provided whose output controls a steering system.

11 Claims, 4 Drawing Sheets

HAND-LEVER CONTROL FOR MOTOR AND SPORT BOATS

CROSS REFERENCE TO RELATED APPLICATIONS

This application is the US national phase of PCT application filed with a claim to the priority of German patent application 19963476.9 itself filed Dec. 28, 1999.

FIELD OF THE INVENTION

The invention relates to a hand-lever control for motor and sport boats with a hand lever having a handle and guided in at least one function plane for controlling the engine.

Such manual-control systems are known. They serve for setting the throttle of an engine. In boat drives where between the motor and the fixed-pitch propeller there is a clutch and/or transmission for forward and reverse, the pilot has a further hand lever by means of which the clutch and/or transmission is operated. If the boat has a variable-pitch propeller another hand lever is provided to control the pitch of the propeller. This hand lever must also be provided in boats with dual-engine drives so that if necessary the two engines, the clutches, transmissions, and variable-pitch props can also each be controlled by respective hand levers. If the boat has a bow and/or stern rudder, further control systems comprising for example hand levers, switches, or the like are necessary. All these control elements must be operated at the same time or in close succession by the pilot, in particularly when steering in restricted water.

It is an object of the invention to ease steering for the pilot.

This object is attained in that the hand lever or its handle are pivotal about the axis of the hand lever in two directions against a spring force and that at least one sensor detecting this rotation is provided whose output controls a steering system. The sensor can be, for example, a potentiometer or switch. The hand lever or its handle can take care of a further control function that is initiated by pivoting in one or another direction. At least one additional hand lever can be eliminated. This not only saves space at the steering pulpit, but it improves the maneuver ability and safety of the boat.

Preferred control functions initiated by rotation of the hand lever or its handle are described in the following.

Thus the output signal can operate a bow and/or stern rudder. This is in particular for motor and sport boats with an engine connected via a clutch and transmission to a fixed-pitch propeller.

In motor and sport boats with dual engines and the respective clutches, transmissions, and fixed-pitch propellers, the output signal produced by rotating the hand lever or the handle can open one of the clutches so that one of the fixed-pitch propellers is left idling while the other fixed-pitch propeller produces thrust and thereby initiates a change in course. In addition to this, the output signal can, when it exceeds a predetermined threshold value, reverse the transmission connected with the opened clutch and then reengage this clutch so that the one fixed-pitch propeller exerts forward thrust and the other fixed-pitch propeller exerts reverse thrust.

In motor and sport boats with two engines and respective variable-pitch propellers coupled to them, the output signal dependent on rotation direction of the hand lever or the handle increases the pitch of the one and decreases the pitch of the other variable-pitch propeller so that in this case also the one variable-pitch propeller produces forward thrust and the other variable-pitch propeller produces reverse thrust. Preferably this is done while changing the pitches of the two variable-pitch propellers to the same extent.

In order to avoid unintended course changes from unintentional pivoting of the hand lever or the handle, the hand lever or its handle are movable axially in a slot guide. In particular the hand lever has an axial bore slidably receiving a rod carrying the handle, the rod being braced in the axial bore on a spring and the axial bore having at least one guide for a radial projection of the rod. The guide can have an axially extending section and an angular section extending from it. Near the ends of the angular sections there are respective sensors contacting with the radial projection of the rod.

Embodiments of the ivention shown in the drawing are described in the following; therein:

Figure 1:
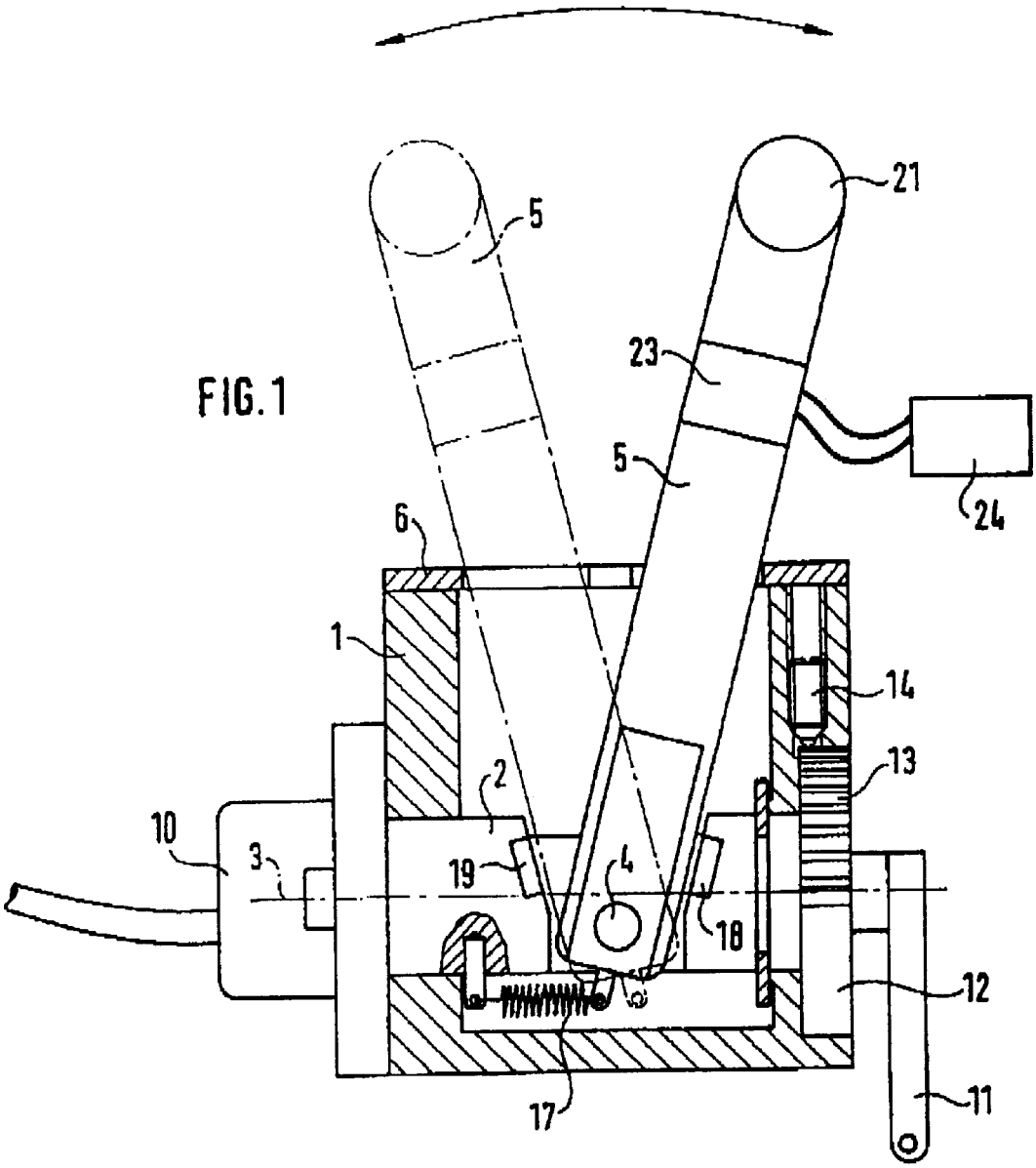
FIG. 1 is a partly axial section through a hand-lever control lever for motor or sport boats.

The illustrated hand-lever control has a housing 1 with a shaft 2 pivoted therein. The shaft 2 rotationally supports a pivot 4 of a hand lever 5 extending orthogonal to an axis 3 of the shaft 2. The hand lever 5 extends through a housing cover 6 with control tracks 7, 8, and 9.

The shaft 2 is connected with a potentiometer 10 which belongs to an otherwise unillustrated controller for an unillustrated variable-pitch propeller. The shaft 2 is also connected with the controls of an unillustrated engine. In the illustrated embodiment to this end there is an arm 11 connected for example via a cable to a throttle.

The shaft 2 carries a wheel 12 with peripheral teeth 13 in which a spring-loaded detent 14 on the housing engages so that the pivotal positions of the hand lever 5 in the tracks 7, 8, or 9 and the pivotal positions of the shaft 2 are maintained even after the hand lever 5 is released.

The pivotal positions of the hand lever 5 are defined by the tracks 7, 8, and 9. To this end the tracks 7 and 8 define a first function plane with a central null point 15 for the hand lever while the track 9 defines a second function plane with an end point 16 only reachable via the null point 15. The hand lever 5 is pivoted by a spring 17 engaged between shaft 2 and the lever 5 always out of the null point 15 toward the end position 16.

Only when the hand lever 5 is in the end position 16 can the unillustrated engine be started. To this end in the illustrated embodiment there is on the shaft a switch 18 that belongs to an unillustrated control circuit for starting the engine. Only when the hand lever 5 is in the end position 16 against the switch can the engine be started. So long as the hand lever is in the end position 16 or even in the null position 15, the engine idles. When the lever 5 is moved from the end position 16 along the track 9, the engine speed is increased, e.g. for warming up or the like.

So long as the hand lever 5 is in the end position 16, a clutch between the engine and the variable-pitch propeller is open. If the hand lever 5 is moved from the end position 16 against the force of its spring 17 into the null position 15, it then comes into engagement with another switch 19 mounted on the shaft 2 and closes the clutch. This rotates the variable-pitch propeller at the idle speed of the engine.

From the null position 15 the hand lever can be pivoted either along the track 7 or along the track 8. Movement of the lever 5 along the track 7 first sets the pitch of the vanes of the variable-pitch propeller positive, that is for forward movement. To start with the engine runs in this embodiment at idle speed. Only after pivoting through a certain minimum travel the engine speed ins increased. On shifting from forward to reverse, the hand lever 5 always passes through the null position 15 so that the engine is slowed to idle. If the hand lever 5 is released in the null position 15, the spring 17 pivots it into the end position 16 and thereby opens the clutch between the engine and the variable-pitch propeller.

Figure 2:
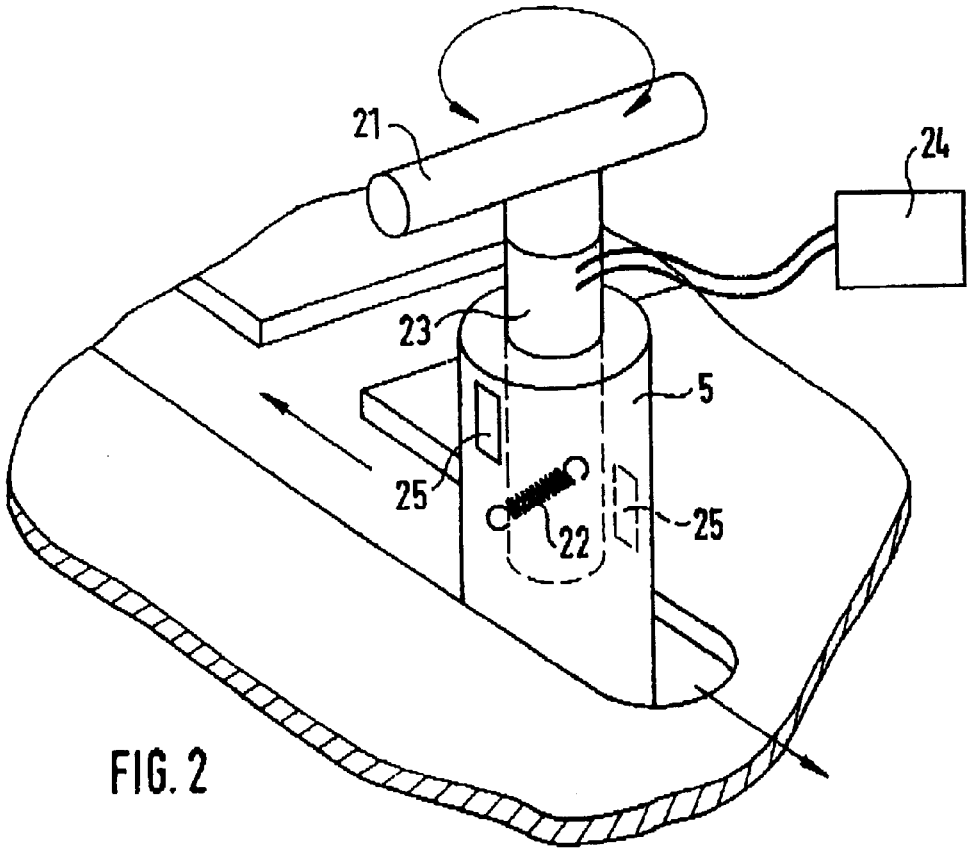
FIG. 2 shows part of the structure of FIG. 1 in perspective view.

In the embodiment illustrated in FIGS. 1 and 2 a handle 21 is pivotal on the hand lever 5 about its axis in two directions against the force of an only schematically illustrated spring 22. A sensor 23 integrated in the lever 5, in this embodiment a potentiometer, determines the positive or negative angular offset and feeds an output signal to a control circuit 24. Instead of the potentiometer or in additional thereto a switch 25 detecting position could be provided.

If the boat has, in addition to an engine, clutch, transmission, and fixed-pitch propeller, also a bow and/or stern rudder, this also can be controlled by rotation of the handle 21 in one of two directions against the spring force so long as the handle 5 is in one of the tracks 7 or 8 or near the null position 15. If the handle 21 is moved back into its starting position, the bow and/or stern rudder is deactivated. In practice the pilot can steer the boat with one hand, without having to let go of the handle 21 and thus of the lever 5.

Figure 4:
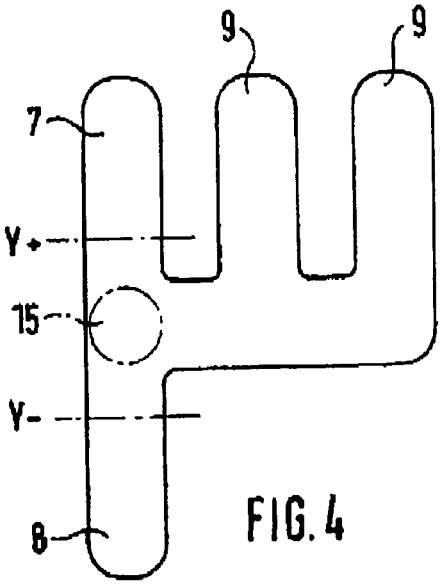
FIG. 4 is another embodiment of what is shown in FIG. 3.

Identical reference numerals are used in FIG. 4 for identical structure. A control-track arrangement is illustrated for a boat with two engines and respective fixed-pitch propellers with respective clutches and transmissions. The two control tracks 9 are intended for warming up the two engines, that is each control track serves for controlling the throttle of one respective engine in order to change its speed. If the hand lever 5 is moved from the null position into one of the control tracks 7 or 8, the clutches of the transmissions are switched for forward or reverse, respectively, as soon as the lever 15 passes the positions shown at Y+ and Y−. Rotation of the handle 21 in one or the other direction will operate the controller 24 to send an output signal to open one or the other clutch so that the respective fixed-pitch propeller drops out and only the other fixed-pitch propeller is effective.

Although not illustrated, on exceeding a predetermined threshold level of the output signal or when triggered by a further output signal from the switch 25, the transmission connected with the opened clutch is shifted and the respective clutch is closed again so that forward thrust is delivered by the respective fixed-pitch propeller and the other fixed-pitch propeller is reversed. If the hand lever 21 is returned to its starting position, the original relationships are restored.

Figure 3:
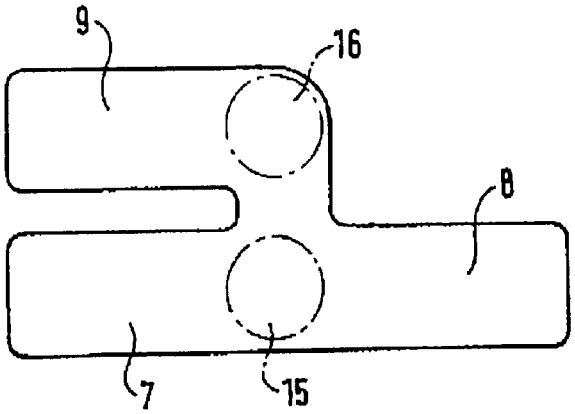
FIG. 3 is a top view of the switching tracks of a housing cover.
Figure 5:
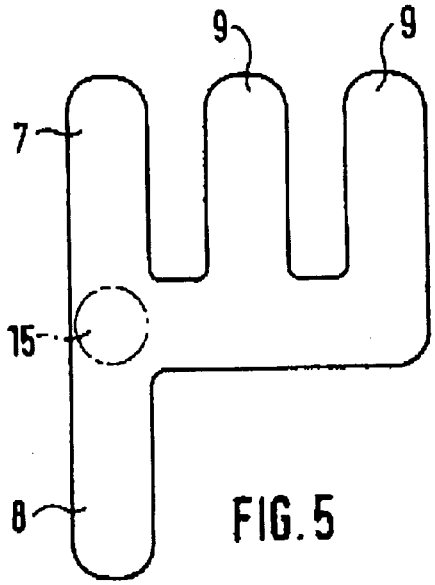
FIG. 5 is another embodiment of what is shown in FIG. 3.

Identical reference numerals are used in FIG. 5 for identical structure. This control-track arrangement is intended for a boat with two engines connected via respective clutches to respective variable-pitch propellers. The two control tracks 9 serve for warming up one or the other engine. When the hand lever 5 is moved out of the null position 15 into one of the two control tracks 7 or 8, the drive acts as described with reference to the embodiment of FIG. 3. If the handle 21 is then rotated in one or the other direction, the controller 24 produces an output signal that increases the pitch of one of the variable-pitch propellers and decreases the pitch of the other variable-pitch propeller so that the one variable-pitch propeller delivers more thrust than the other variable-pitch propeller or one variable-pitch propeller produces forward thrust and the other variable-pitch propeller reverse thrust. Preferably the pitches of the two variable-pitch propellers are varied to the same extent. If the hand lever 21 is returned to its starting position, the changes of the pitches are undone.

Figure 6:
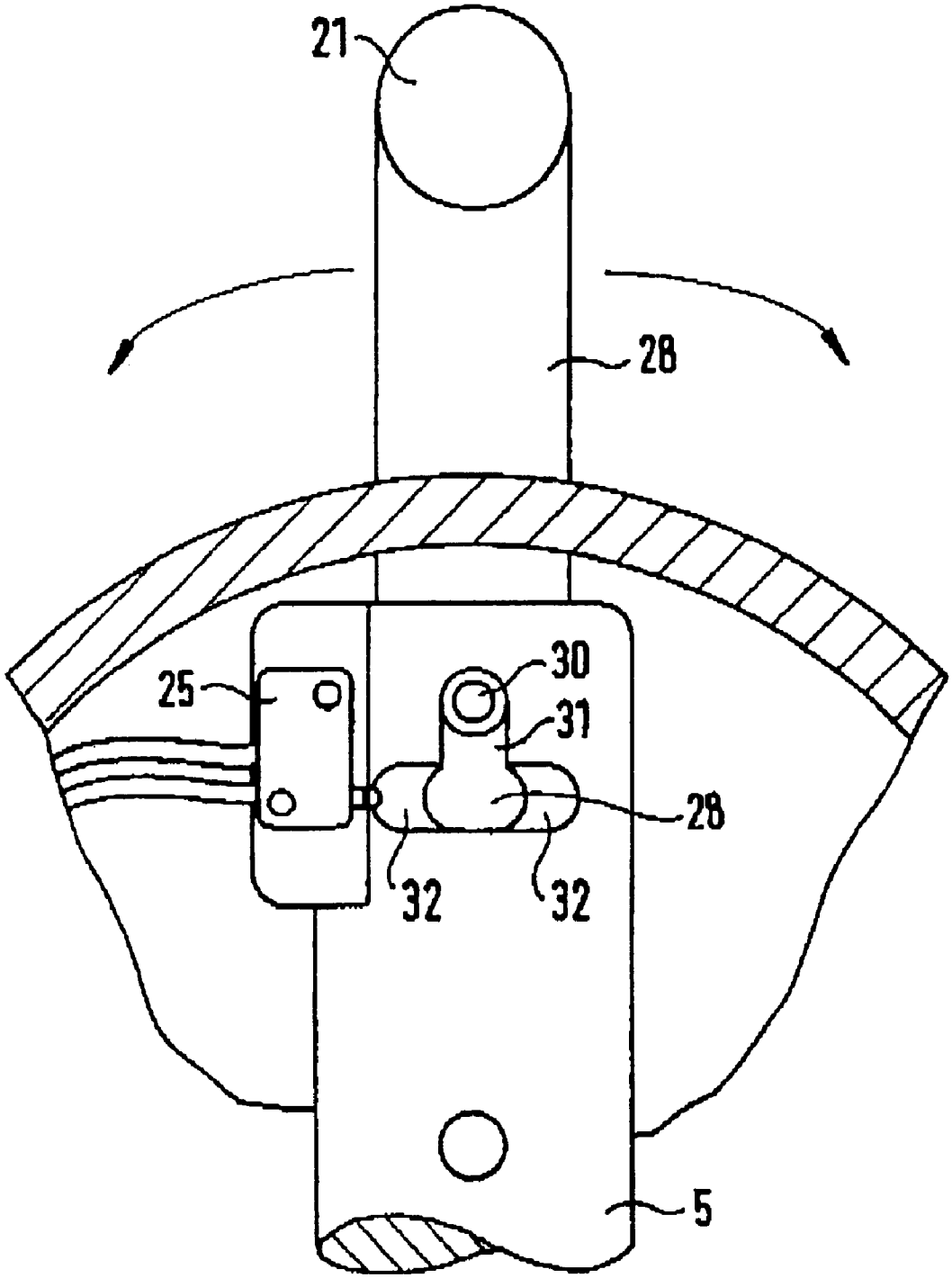
FIG. 6 is a schematically illustrated other embodiment of the structure of FIG. 2.
Figure 7:
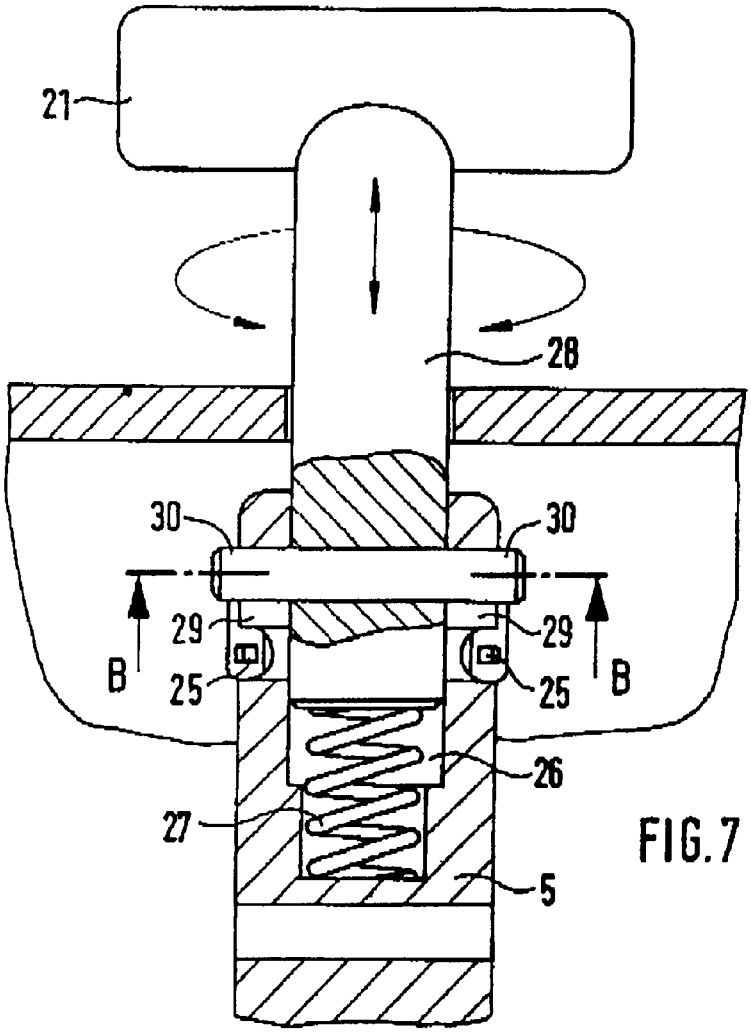
FIG. 7 is a partial axial section through the structure of FIG. 6.
Figure 8:
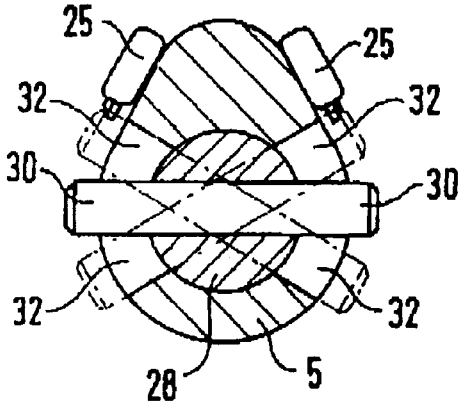
FIG. 8 is a section along line B—B through the structure of FIG. 7.

Identical reference numerals are used in FIGS. 6 and 7 for identical structure. The hand lever 5 has at its upper end an axial bore 26 against whose floor engages a spring 27 that is also braced against a rod 28 carrying the hand lever 21. Radial projections 30 of the rod 28 engage in guides 29 provided on opposite sides in the region of the axial bore 26. In the illustrated embodiment the radial projections 30 are formed by a throughgoing pin. The guides 29 have portions 31 extending axially. Angular portions 32 extend from lower ends of these sections 31 and hold switches 25 which can cooperate with the radial projections 30. In this arrangement inadvertent rotation of the handle 1 does not create unwanted movements. Instead in order to steer it is necessary to press the handle 21 down against the force of the spring 27 until the radial projections 23 engage in the angular portions 32. Only then can the handle 21 be rotated in one of the two directions.

What is claimed is:

1. In combination with a motor or sports boat having an engine, a propeller drivable by the engine, and a steering system:

a hand lever pivotal on the boat about a main axis and extending along a handle axis generally orthogonal to the main axis, the handle axis defining a function plane on pivoting of the handle about the main axis;

a part carried on the hand lever and pivotal thereon about the lever axis from a central position into a pair of opposite end positions;

speed-control means connecting the hand lever to the engine for varying a speed of same in accordance with the angular position of the hand lever in the function plane;

a sensor contacting with the part and producing an output on movement of same out of the center position into one of the end positions;

direction-control means connected between the sensor and the steering system for operating the steering system in accordance with the output.

2. The combination defined in claim 1 wherein the lever is formed with a bore extending parallel to the lever axis and the part has an axially extending rod slidable axially of the lever axis in the bore, further comprising:

a spring urging the rod and part axially outward in the bore;

a projection extending radially of the lever axis on the lever;

a guide on the lever extending axially of the lever axis and slidably receiving the projection, the sensor being position such that it can only be actuated to produce its output when the part is pushed in against the spring force past a predetermined position.

3. The combination defined in claim 2 wherein the guide is formed with an axially extending leg and, at an inner end thereof, with an angularly extending leg, the sensor being operable by the projection and being at an end of the angularly extending leg.

4. The combination defined in claim 1 wherein there are two such sensors, each responding when the part is pivoted about the lever axis into a respective one of the end positions, the control means directing the boat to port when one of the sensors produces its output and to starboard when the other of the sensors-produces its output.

5. The combination defined in claim 4 wherein the part is a handle extending in the center position transverse to the lever axis and generally parallel to the main axis.

6. The combination defined in claim 4 wherein the boat has, in addition to the first-mentioned engine and propeller, a second engine and a second propeller driven by the second engine, the speed-control means being connected to both engines.

7. The combination defined in claim 6 wherein each of the engines is provided with a respective openable clutch and transmission by means of which it is connected to the respective propeller, the propellers being fixed-pitch propellers, the one clutch being opened by the direction-control means when the first sensor is actuated and the other clutch being opened by the direction-control means when the second sensor is actuated.

8. The combination defined in claim 7 wherein when one of the sensors is actuated beyond a predetermined limit, the other sensor reverses the respective propeller and closes the respective clutch.

9. The combination defined in claim 6 wherein both propellers are of variable pitch and connected to the direction-control means, the direction control means, on generation of the output by one of the sensors, increasing the pitch of one oft he propellers and decreasing the pitch of the other.

10. The combination defined in claim 9 wherein on increasing one pitch and decreasing the other, both pitches are varied to the same extent.

11. The combination defined in claim 6 wherein the steering system includes a rudder deflected in accordance with the output.

* * * * *